US005410939A

United States Patent [19]

Matamoros et al.

[11] Patent Number: 5,410,939

[45] Date of Patent: May 2, 1995

[54] MUSICAL INSTRUMENT STRING WINDING DEVICE

[76] Inventors: Brian S. Matamoros, 14403 Mansel Ave., Lawndale, Calif. 90260; Aaron A. Grodin, 4818 Reese Rd., Torrance, Calif. 90505

[21] Appl. No.: 210,424

[22] Filed: Mar. 21, 1994

[51] Int. Cl.[6] ..... G10G 7/00

[52] U.S. Cl. ..... 84/458; 362/119; 362/253

[58] Field of Search ..... 84/458, 454, 453, DIG. 18; 362/109, 119, 253; 242/47

[56] References Cited

U.S. PATENT DOCUMENTS 4,791,849 12/1988 Kelley ..... 84/458

4,889,029 12/1989 St. Denis ..... 84/454

*Primary Examiner*—M. L. Gillner

*Assistant Examiner*—Cassandra C. Spyrou

[57] ABSTRACT

A musical instrument string winding device is set forth for winding the strings on a stringed musical instrument. The device has a hollow housing. A chuck is extended from the housing for receiving a key of a musical instrument. A motor is disposed within the housing and coupled to the chuck for imparting rotational movement thereto. A lamp is extended from the housing for illuminating the chuck. A battery is disposed within the housing for energizing the motor and lamp. A switch is coupled between the battery, motor, and lamp. The switch is operable in one orientation for activating both the motor and lamp, whereby simultaneously allowing a key disposed within the chuck to be illuminated and a string coupled to the key to be wound. The switch is operable in another orientation for deactivating the motor and lamp.

2 Claims, 4 Drawing Sheets

MUSICAL INSTRUMENT STRING WINDING DEVICE

BACKGROUND OF THE INVENTION

1. Field of the Invention

The present invention relates to a string winding device and more particularly pertains a musical instrument string winding device for winding the strings on a stringed musical instrument.

2. Description of the Prior Art

The use of winding devices is known in the prior art. More specifically, winding devices heretofore devised and utilized for the purpose of winding the strings on a stringed musical instrument are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,098,163 to Kato discloses a string winding device for string instruments; No. 4,791,849 to Kelley discloses a motorized string tuning apparatus; No. 4,889,029 to St. Denis discloses a tuning apparatus for stringed instruments; No. 5,065,660 to de Buda discloses a piano tuning system; and No. 5,097,736 to Turner discloses a stringed instrument tuning device.

While these devices fulfill their respective, particular objective and requirements, the aforementioned patents do not describe a musical instrument string winding device that has a built-in lamp that is simultaneously activated when the winding motor is activated for winding, thus enabling a musician to view and control the winding process in areas of reduced visibility.

In this respect, the musical instrument string winding device according to the present invention substantially departs from the conventional concepts and designs of the prior art, and in doing so provides an apparatus primarily developed for the purpose of winding the strings on a stringed musical instrument.

Therefore, it can be appreciated that there exists a continuing need for new and improved musical instrument string winding device which can be used for winding the strings on a stringed musical instrument. In this regard, the present invention substantially fulfills this need.

SUMMARY OF THE INVENTION

In the view of the foregoing disadvantages inherent in the known types of winding devices now present in the prior art, the present invention provides an improved musical instrument string winding device. As such, the general purpose of the present invention, which will be described subsequently in greater detail, is to provide a new and improved musical instrument string winding device and method which has all the advantages of the prior art and none of the disadvantages.

To attain this, the present invention essentially comprises, in combination, a hollow housing having an opening for allowing access therein; an essentially cylindrical and transparent chuck disposed within the housing, the chuck having an upper end with a socket formed thereon adapted to receive a key of a musical instrument and a lower end having a gear formed therearound; a motor disposed within the housing, the motor having a fixed stator with a rotatable rotor extending therefrom and coupled with the gear for imparting rotational movement to the chuck; a lamp disposed within the housing and positioned under gear of the chuck; a concave reflector coupled about the lamp for reflecting light from the lamp for illuminating the chuck; a power source disposed within the housing for energizing the motor and the lamp; primary switch means coupled between the power source, the motor, and the lamp, the primary switch means operable in one orientation for activating both the motor and the lamp, whereby simultaneously allowing a key placed in the socket of the chuck to be illuminated and a string coupled to the key to be wound, and operable in another orientation for deactivating the motor and the lamp; secondary switch means coupled between the power source and the lamp, the secondary switch means operable in one orientation for activating only the lamp, whereby providing light through the chuck for illuminating nearby objects for viewing, and operable in another orientation for deactivating the lamp; a lid coupled over the central opening for sealing the power source, motor, switch means, and lamp within the container, the lid having a first aperture and second aperture disposed thereon with the first aperture axially aligned about the chuck near the gear; and a hand grip coupled within the second aperture of the lid and projected therefrom for placing the primary switch means in the operable orientation when the grip is compressed by hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved musical instrument string winding device which has all the advantages of the prior art winding devices and none of the disadvantages.

It is another object of the present invention to provide a new and improved musical instrument string winding device which may be easily and efficiently manufactured and marketed.

It is a further object of the present invention to provide a new and improved musical instrument string winding device which is of durable and reliable construction.

An even further object of the present invention is to provide a new and improved musical instrument string winding device which is susceptible of a low cost of manufacture with regard to both materials and labor, and which accordingly is then susceptible of low prices of sale to the consuming public, thereby making such a musical instrument string winding device economically available to the buying public.

Still yet another object of the present invention is to provide a new and improved musical instrument string winding device which provides in the apparatuses and methods of the prior art some of the advantages thereof, while simultaneously overcoming some of the disadvantages normally associated therewith.

Even still another object of the present invention is to provide a new and improved musical instrument string winding device for winding the strings on a stringed musical instrument.

Lastly, it is an object of the present invention is to provide a new and improved musical instrument string winding device comprising a hollow housing; a chuck disposed within the housing and adapted to receive a key of a musical instrument therein; a motor disposed within the housing for imparting rotational movement to the chuck; illumination means disposed within the housing for illuminating the chuck; a power source disposed within the housing for energizing the motor and illumination means; and primary switch means coupled between the power source, motor, and illumination means, the primary switch means operable in one orientation for activating both the motor and illumination means, whereby simultaneously allowing a key disposed within the chuck to be illuminated and a string coupled to the key to be wound, and operable in another orientation for deactivating the motor and illumination means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
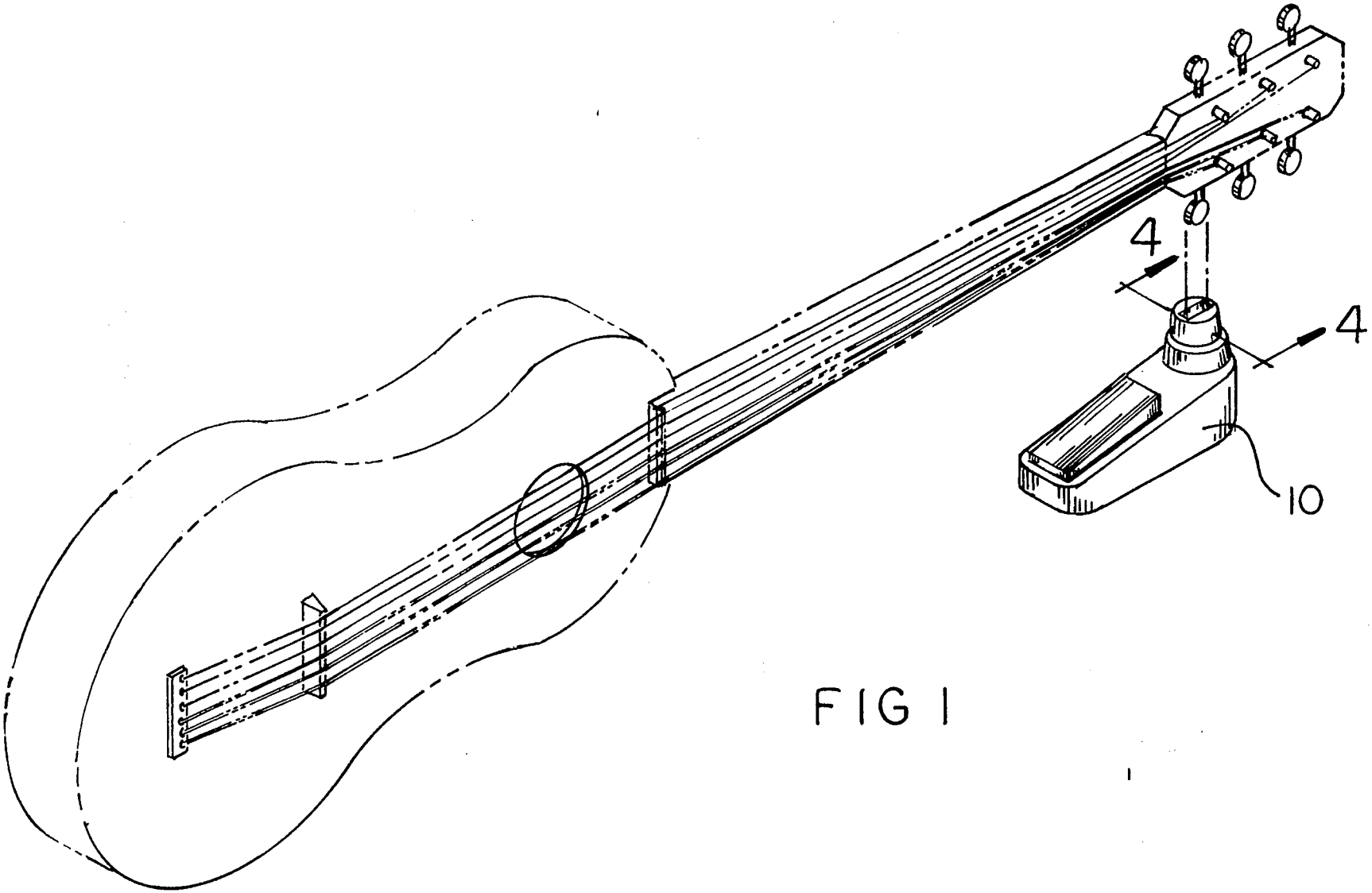
FIG. 1 is a perspective view of the preferred embodiment of the musical instrument string winding device constructed in accordance with the principles of the present invention.
Figure 2:
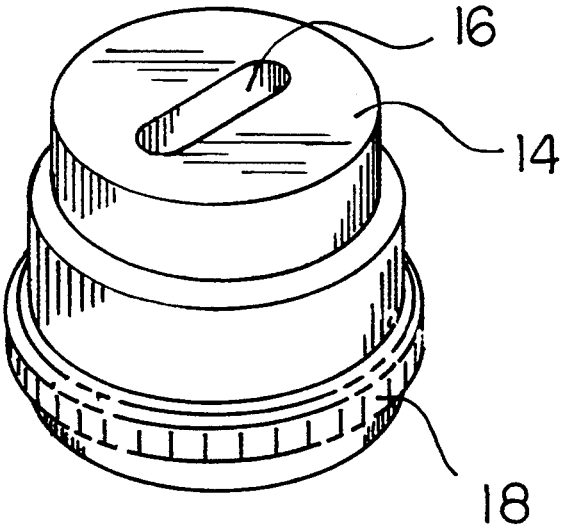
FIG. 2 is a perspective view of the chuck of the present invention.
Figure 4:
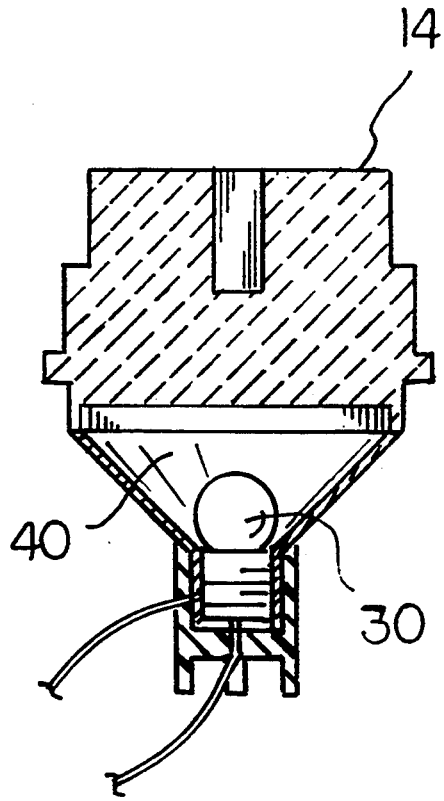
FIG. 4 is a cross sectional view of the light source, reflector, and chuck of the present invention taken along the line 4—4 of FIG. 1.
Figure 3:
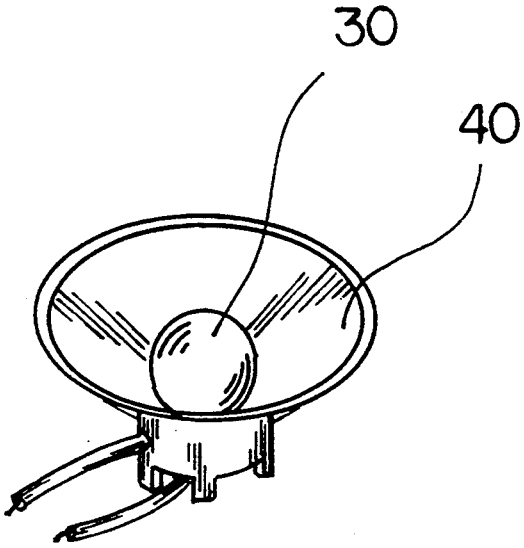
FIG. 3 is a perspective view of the light source and reflector of the present invention.
Figure 5:
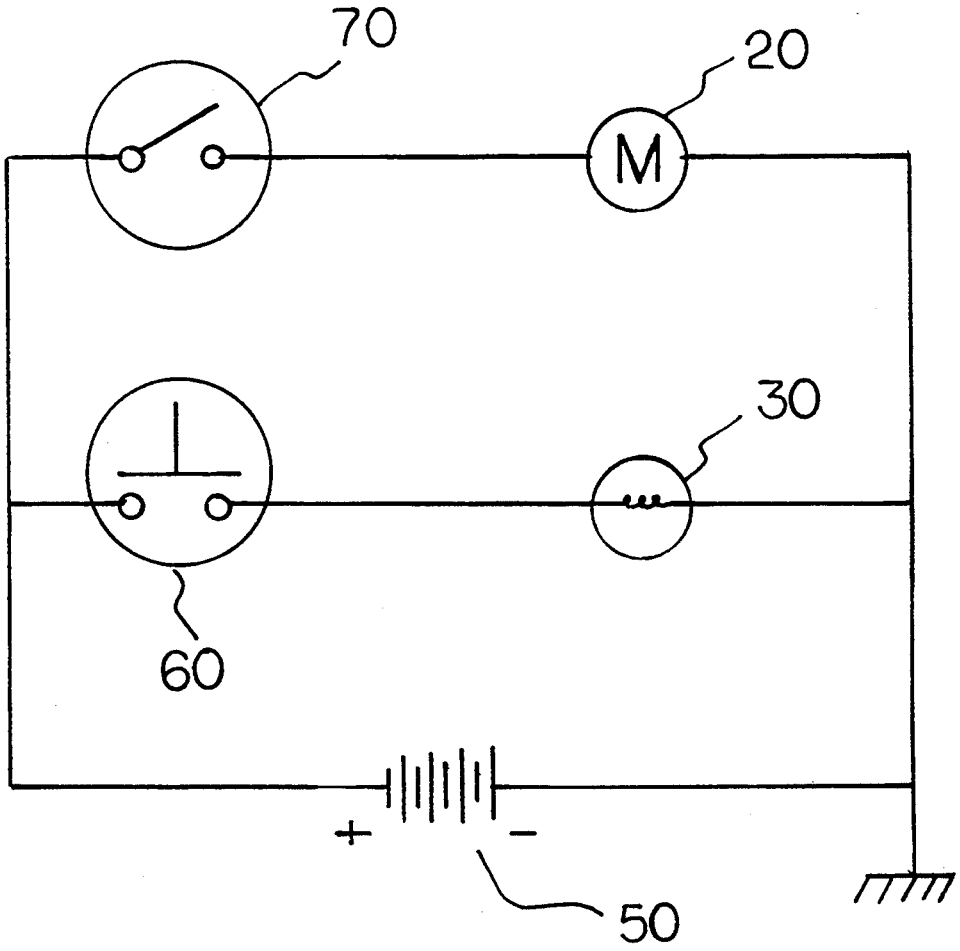
FIG. 5 is a schematic diagram depicting the electrical coupling between the switch means, motor, light source and power source of the present invention.
Figure 6:
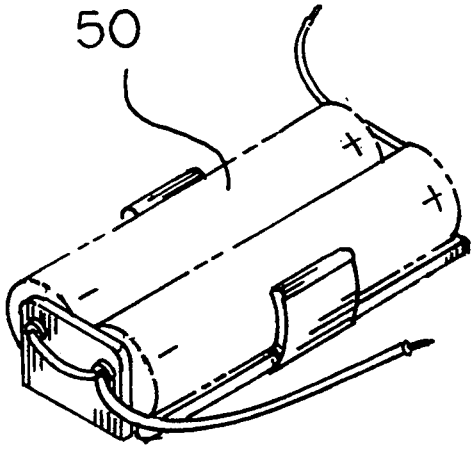
FIG. 6 is a perspective view of the power source of the present invention.
Figure 7:
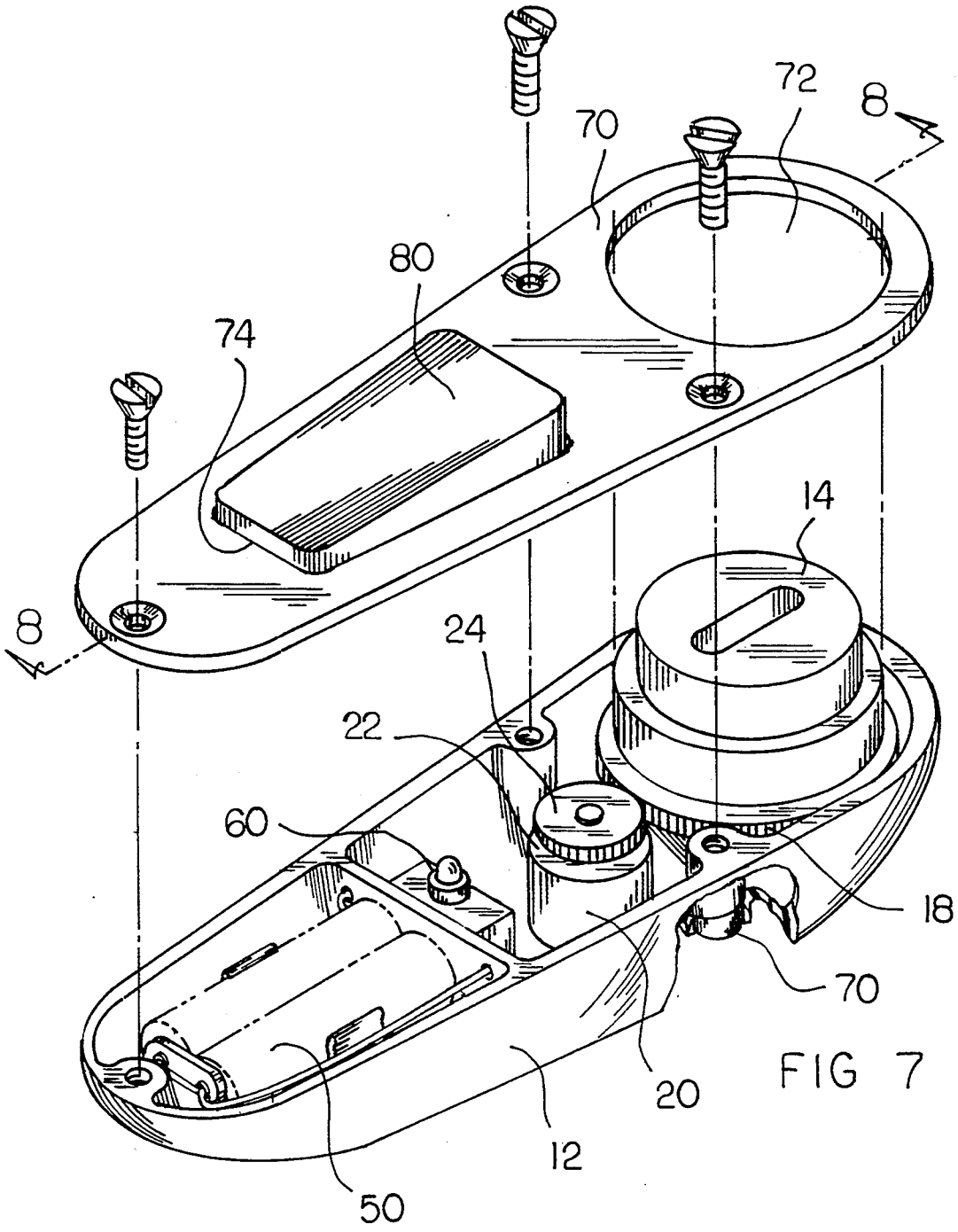
FIG. 7 is an exploded view of the components of the present invention.
Figure 8:
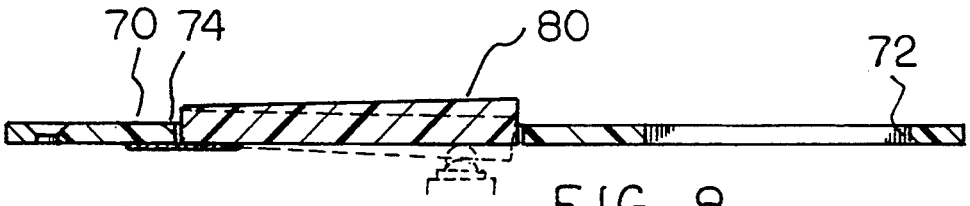
FIG. 8 is a cross sectional view of the coupling between the hand grip and the switch means of the present invention taken along the line 8—8 of FIG. 7.

With reference now to the drawings, and in particular, to FIG. 1 thereof, the preferred embodiment of the new and improved musical instrument string winding device embodying the principles and concepts of the present invention and generally designated by the reference number 10 will be described.

Specifically, the present invention includes 10 major components. The major components are the housing, chuck, motor, lamp, reflector, power source, primary switch means, secondary switch means, lid, and hand grip. These components are interrelated to provide the intended function.

More specifically, it will be noted in the various Figures that the first major component is the housing 12. The housing is rigid in structure. The housing has an opening for allowing access therein.

The second major component is the chuck 14. The chuck is essentially cylindrical and transparent in structure. The chuck is disposed within the housing 12. The chuck has an upper end with a socket 16 formed thereon. The socket is adapted to receive a key of a musical instrument therein. The lower end of the socket has a gear 18 formed therearound.

The third major component is the motor 20. The motor is disposed within the housing 12. The motor has a fixed stator 22 and a rotatable rotor 24 extending therefrom. The motor stator is coupled with the gear 18 for imparting rotational movement to the chuck 14.

The fourth major component is the lamp 30. The lamp is adapted to provide illumination. The lamp is disposed within the housing 12 and positioned under the gear 18 of the chuck.

The fifth major component is the reflector 40. The reflector is coupled about the lamp. The reflector is formed to reflect light from the lamp 30 for illuminating the chuck 14.

The sixth major component is the power source 50. The power source is disposed within the housing 12. The power source is used to energize the motor 20 and the lamp 30.

The seventh major component is the primary switch means 60. The primary switch means is coupled between the power source 50, the motor 20, and the lamp 30. The primary switch means is operable in one orientation for activating both the motor and the lamp, whereby simultaneously allowing a key placed in the socket 16 of the chuck to be illuminated and a string coupled to the key to be wound. The switch means has another orientation for deactivating the motor and the lamp.

The eighth major component is the secondary switch means 70. The secondary switch means is coupled between the power source 50 and the lamp 30. The secondary switch means is operable in one orientation for activating only the lamp, whereby providing light through the chuck for illuminating nearby objects for viewing. The secondary switch means has another orientation for deactivating the lamp.

The ninth major component is the lid 71. The lid is coupled over the central opening of the container 12 for sealing the power source 50, motor 20, primary and secondary switch means 60, 70, and lamp 30 therein. The lid has a first aperture 72 and a second aperture 74 disposed thereon. The first aperture is axially aligned with the chuck 14 and disposed therearound to be located near the gear 18.

The tenth major component is the hand grip 80. The hand grip is coupled within the second aperture 74 of the lid. The hand grip extends from the container. The hand grip is used to place the primary switch means 60 in an operable orientation when the grip is compressed by hand.

In the preferred embodiment, the housing, chuck, and lid are made of molded plastic. The housing is formed to fit squarely in the palm of one hand. The hand grip is made of foam, thus preventing the device from slipping when being used. The reflector, primary switch means, secondary switch means, are conventional in design and are commercially available. In the preferred embodiment the primary switch means is incorporated into the hand grip. In alternate embodiments, the primary switch means is positioned in an alternate location which would require it to be turned on deliberately. The power source is made up of a plurality of batteries.

The device allows musicians working in a darkened area to wind strings on musical instruments. When the device is activated, the work area is well lighted, thus allowing the winding to proceed without difficulty. The transparent chuck also enables the musician to clearly see that the key is well seated in the socket. Consequently, the device frees the musician from having to use a supplementary flashlight. The string winding device is also sized so that it can be stored with a musical instrument in a musician's instrument case.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A musical instrument string winding device for winding the strings on a stringed musical instrument comprising, in combination:

a hollow housing having an opening for allowing access therein;

an essentially cylindrical and transparent chuck disposed within the housing, the chuck having an upper end with a socket formed thereon adapted to receive a key of a musical instrument and a lower end having a gear formed therearound;

a motor disposed within the housing, the motor having a fixed stator with a rotatable rotor extending therefrom and coupled with the gear for imparting rotational movement to the chuck;

a lamp disposed within the housing and positioned under the gear of the chuck;

a concave reflector coupled about the lamp for reflecting light from the lamp for illuminating the chuck;

a power source disposed within the housing for energizing the motor and the lamp;

primary switch means coupled between the power source, the motor, and the lamp, the primary switch means operable in one orientation for activating both the motor and the lamp, whereby simultaneously allowing a key placed in the socket of the chuck to be illuminated and a string coupled to the key to be wound, and operable in another orientation for deactivating the motor and the lamp;

secondary switch means coupled between the power source and the lamp, the secondary switch means operable in one orientation for activating only the lamp, whereby providing light through the chuck for illuminating nearby objects for viewing, and operable in another orientation for deactivating the lamp;

a lid coupled over the opening of the housing for sealing the power source, motor, primary and secondary switch means, and lamp within the housing, the lid having a first aperture and second aperture disposed thereon with the first aperture axially aligned about the chuck near the gear; and a hand grip coupled within the second aperture of the lid and projected therefrom for placing the primary switch means in the operable orientation when the grip is compressed by hand.

2. A musical instrument string winding device for winding the strings on a stringed musical instrument comprising:

a hollow housing;

a chuck disposed within the housing and adapted to receive a key of a musical instrument therein;

a motor disposed within the housing and operatively coupled to the chuck for imparting rotational movement thereto;

illumination means disposed within the housing for illuminating the chuck;

a power source disposed within the housing for energizing the motor and illumination means;

primary switch means coupled between the power source, motor, and illumination means, the primary switch means operable in one orientation for activating both the motor and illumination means, whereby simultaneously allowing a key disposed within the chuck to be illuminated and a string coupled to the key to be wound, and operable in another orientation for deactivating the motor and illumination means; and secondary switch means coupled between the power source and the illumination means, the secondary switch means operable in one orientation for activating only the illumination means, whereby providing light for illuminating nearby objects for viewing, and operable in another orientation for deactivating the illumination means.

* * * * *